US010830090B2

(12) United States Patent
Mairhanser

(10) Patent No.: US 10,830,090 B2
(45) Date of Patent: Nov. 10, 2020

(54) VANE ACTUATING MECHANISM HAVING A LATERALLY MOUNTED ACTUATING LEVER

(71) Applicant: MTU Aero Engines AG, Munich (DE)

(72) Inventor: Vitalis Mairhanser, Sigmertshausen (DE)

(73) Assignee: MTU Aero Engines AG, Munich (DE)

( * ) Notice: Subject to any disclaimer, the term of this patent is extended or adjusted under 35 U.S.C. 154(b) by 338 days.

(21) Appl. No.: 15/825,962

(22) Filed: Nov. 29, 2017

(65) Prior Publication Data

US 2018/0163560 A1 Jun. 14, 2018

(30) Foreign Application Priority Data

Dec. 8, 2016 (DE) ..... 10 2016 224 523

(51) Int. Cl.

| | |
|---|---|
| ***F01D 17/20*** | (2006.01) |
| ***F01D 9/04*** | (2006.01) |
| ***F01D 17/14*** | (2006.01) |
| ***F01D 17/16*** | (2006.01) |
| ***F04D 29/56*** | (2006.01) |

(52) U.S. Cl.

CPC ..... *F01D 17/20* (2013.01); *F01D 9/041* (2013.01); *F01D 17/14* (2013.01); *F01D 17/16* (2013.01); *F01D 17/162* (2013.01); *F04D 29/563* (2013.01)

(58) Field of Classification Search

CPC ..... F01D 17/148; F01D 17/20; F01D 17/16; F01D 17/162; F01D 17/165; F01D 17/14; F01D 9/041; F01D 9/042; F04D 29/56; F04D 29/563; F05D 2260/31; F05D 2260/36

See application file for complete search history.

(56) References Cited

U.S. PATENT DOCUMENTS 4,307,994 A * 12/1981 Brewer ..... F01D 17/162 415/160
4,979,874 A * 12/1990 Myers ..... F01D 7/00 415/160
5,492,446 A 2/1996 Hawkins
6,019,574 A * 2/2000 DiBella ..... F01D 17/162 415/148

(Continued)

FOREIGN PATENT DOCUMENTS

| | | |
|---|---|---|
| CH | 703871 | 3/2012 |
| DE | 19537784 | 6/1996 |

(Continued)

*Primary Examiner* — David E Sosnowski
*Assistant Examiner* — Wayne A Lambert
(74) *Attorney, Agent, or Firm* — Davidson, Davidson & Kappel, LLC

(57) ABSTRACT

A lever assembly forming part of a vane actuating mechanism and serving to connect a stator vane of a turbomachine to an actuating ring of an actuator is provided. The lever assembly is adapted such that an actuating lever of the lever assembly is moved in a first mounting direction transversely to a vane stem of the stator vane extending radially relative to a longitudinal machine axis of the turbomachine and is thereby positioned laterally against the vane stem, and that the actuating lever is radially form-fittingly locked to the vane stem by a locking piece in a second mounting direction. An assembly method and a turbomachine is also provided.

14 Claims, 7 Drawing Sheets

(56) References Cited

U.S. PATENT DOCUMENTS

| | | | | |
|---|---|---|---|---|
| 6,802,692 | B2 * | 10/2004 | Bouru | F01D 17/16 403/286 |
| 6,984,105 | B2 * | 1/2006 | Clark | F01D 17/162 415/160 |
| 7,011,494 | B2 * | 3/2006 | Kies | F01D 17/162 415/148 |
| 7,104,754 | B2 * | 9/2006 | Willshee | F01D 17/162 415/159 |
| 7,223,066 | B2 * | 5/2007 | Rockley | F01D 17/162 415/160 |
| 7,344,355 | B2 * | 3/2008 | Wilshaw | F01D 17/162 415/160 |
| 7,524,165 | B2 | 4/2009 | Bourgoin et al. | |
| 8,651,803 | B2 * | 2/2014 | Jones | F01D 17/162 415/160 |
| 8,714,916 | B2 | 5/2014 | Jarret, Jr. et al. | |
| 2004/0081554 | A1 * | 4/2004 | Bruce | F01D 17/162 415/160 |
| 2004/0109762 | A1 * | 6/2004 | Hidalgo | F01D 17/162 415/209.3 |
| 2004/0146398 | A1 * | 7/2004 | Bromann | F01D 17/16 415/148 |
| 2004/0265119 | A1 * | 12/2004 | Raulin | F01D 17/162 415/159 |
| 2007/0172348 | A1 | 7/2007 | Battig | |
| 2012/0263571 | A1 | 10/2012 | Ress | |
| 2014/0219785 | A1 * | 8/2014 | Gasmen | F01D 17/14 415/148 |
| 2015/0361820 | A1 | 12/2015 | Zhou et al. | |
| 2018/0100407 | A1 | 4/2018 | Leopold | |

FOREIGN PATENT DOCUMENTS

| | | |
|---|---|---|
| DE | 102015004648 | 10/2016 |
| EP | 1637742 | 3/2006 |
| EP | 1 811 135 | 7/2007 |
| WO | WO 2011/056167 | 5/2011 |

* cited by examiner

VANE ACTUATING MECHANISM HAVING A LATERALLY MOUNTED ACTUATING LEVER

This claims the benefit of German Patent Application DE 102016224523.6, filed Dec. 8, 2016 and hereby incorporated by reference herein.

The present invention relates to a lever assembly which forms part of a vane actuating mechanism of a turbomachine and serves to establish a link between a stator vane and an actuator, and to a method for establishing a link between a stator vane and an actuator, as well as to a turbomachine.

BACKGROUND

Compressors in axial turbomachines, for example, aircraft engines, typically include a vane actuating mechanism in the area of the forward compressor stages or in the high-pressure compressor. The vane actuating mechanism is used to adjust the stator vanes of the relevant row of stator vanes about their vertical axes as a function of rotational speed, thereby enabling variation of an absolute stator exit angle. This makes it possible to prevent stall during spool-up of the turbomachine or at low rotational speeds. Stage loading is reduced. Alternatively, stall could also be prevented by adjusting the rotor blades of the compressor stages. However, this is technically much more complex, so that adjustment of the stator vanes has become the standard technique.

The adjustment of the stator vanes of a stator vane row is usually effected mechanically by operation of an actuator. The actuator acts on the stator vanes via an actuating ring and respective actuating levers. The actuating ring is disposed outside of the turbomachine and is usually positioned downstream of and coaxially with the stator vane row. It is movable in the circumferential and axial directions of the turbomachine. In the case of multiple compressor stages to be adjusted, the actuating rings are simultaneously driven via an actuator lever which forms part of the actuator and extends in the axial direction of the turbomachine and which is connected to the respective actuating rings.

In known vane actuating mechanisms, the lever is slipped in a radial direction of the turbomachine onto a vane stem extending in the vertical direction of the stator vane. Then, the lever is form-fittingly fixed to a contact portion of the vane stem and secured in position by a threaded connection. The threaded connection may be implemented by means of an internal or external thread. This type of lever attachment requires a vane stem of sufficient thickness for shaping the contact faces. However, due to the geometric boundary conditions, such as a small flow duct diameter and a high vane count, the stem diameter can hardly be larger than the smallest possible external thread. If the stem diameters have to be significantly reduced because of the geometric boundary conditions, the aforedescribed known lever attachment is no longer feasible for stem diameters that are hardly larger than the permitted thread size. Furthermore, due to the small stem diameter and the resulting small length of the contact face with the lever, dimensional tolerance of the contact face has an increasingly negative effect on an angular misalignment of the lever with respect to the vane airfoil.

SUMMARY OF THE INVENTION

It is an object of the present invention to provide a lever assembly forming part of a vane actuating mechanism of a turbomachine and serving to establish a link between a stator vane and an actuator, which lever assembly will overcome the above-mentioned disadvantages. Further objects of the present invention are to provide a method for establishing a link between a stator vane and an actuator, and to provide a turbomachine that allows for a high number of variable stator vanes within a small space.

The present invention provides a lever assembly, a method, and a turbomachine.

An inventive lever assembly forming part of a vane actuating mechanism of a turbomachine and serving to establish a link between a stator vane and an actuator, the stator vane having a vane stem extending along its vertical axis and being connectable by a lever to an actuating ring of the actuator, has a lever having a jaw-like connecting portion by which it is engageable with a contact portion of the vane stem. The inventive lever assembly further has a U-shaped locking piece for locking the connecting portion to the vane stem. The U-shaped locking piece has a passage opening formed in a main body, allowing it to be slid onto the vane stem, as well as two legs extending from the main body at opposite ends. One leg is adapted for insertion into a jaw opening of the connecting portion, and the other leg is adapted for engagement with a mating surface of the connecting portion. In the locked position, the connecting portion and the locking piece are form-fittingly connected to the contact portion.

Because, in accordance with the present invention, the lever is mounted laterally to the vane stem, the lever is no longer slipped onto the vane stem in the longitudinal direction thereof as in the aforedescribed known vane actuating mechanism, which allows the contact portion on the vane stem, which is engaged by the lever, to be configured nearly independently of the other portions of the vane stem. Since the lever is mounted laterally to the vane stem, the diameter of the contact portion does not need to be greater than the thread diameter, which makes the inventive lever assembly also suitable for very small stem diameters. Thus, the vane stem diameter is no longer the decisive factor in the configuration of the contact portion. Therefore, reliable attachment of lever to the vane stem is possible even in the case of a small vane stem diameter. Because of this, the lever assembly is suited, in particular, for use in compressors of turbomachines which require a high vane count within a small available space, such as aircraft engines or compact industrial gas turbines. Due to the virtually nonexistent geometrical boundary conditions of the vane stem, the stem diameter can be reduced significantly.

In an embodiment, a form fit between the connecting portion of the lever and the contact portion of the vane stem is achieved by the connecting portion having opposing jaw faces that are configured to match contact faces of the contact portion, which are angled relative to one another. For example, two plane contact faces may be provided which are angled in a roof-like manner relative to one another when viewed in the longitudinal direction of the vane stem. Preferably, the contact faces are identical in size and shape, but differ in their orientation on the vane stem. For manufacturing and assembly reasons, the jaw faces are also identical in size and shape. As an alternative to a roof-like angular orientation relative to one another, a trapezoidal arrangement or the like is also conceivable. What is important is that the jaw faces and the contact faces not be rotationally symmetric with respect to the vertical axis and that the form fit be free of play.

The contact faces can be easily formed by tapering the vane stem in cross section. For example, they may be manufactured by milling away material. Moreover, as a result of the cross-sectional tapers, shoulder faces are formed in the transition region between the contact faces and the stem portion adjacent the contact portion. In the assembled state, the shoulder faces act as a support for the connecting portion.

Preferably, the mating surface of the connecting portion is a wedge surface and the other leg has a wedged leg surface. The wedge surface and the wedged leg surface are adapted such that the connecting portion and the locking piece are moved toward the contact faces of the contact portion during mounting of the locking piece. Thus, during placement of the locking piece, the connecting portion is moved with its jaw faces toward the contact faces, thereby producing, as it were, a self-locking action on the contact portion.

The leg of the locking piece that is insertable into the jaw opening may have an engagement surface for engagement with a contact face of the contact portion. This measure achieves direct contact not only of the connecting portion but also of the locking piece with the contact portion of the vane stem, which promotes the play-free form fit.

To permit self-centering of the connecting portion on the contact portion, the jaw faces of the connecting portion may diverge as they extend away from the jaw bottom toward the jaw opening, and the leg that is insertable into the jaw opening may have side faces corresponding to the jaw faces. To prevent the leg from getting jammed in the jaw opening during locking, at least one of the side faces is spaced apart from the jaw face opposite thereto in the assembled state.

Absence of play can be reliably ensured by means of a clamping device for clamping the connecting portion and the locking piece in the locked position. In particular in combination with the wedge surface and the wedged leg surface, the connecting portion and the locking piece are pressed against the contact faces of the contact portion in the clamped state. The clamping device includes, for example, a nut which is screwed onto an external thread of a free end portion of the vane stem. Instead of an external thread, it is also possible to form an internal thread if the nut is adapted accordingly.

To secure the clamping action, it is advantageous to provide a securing element to be disposed between the locking piece and the clamping device and having at least one arm that can be bent to laterally engage the locking piece and/or the connecting portion. Alternatively or additionally, the clamping device may also be self-retaining, for example in the form of a self-retaining nut. Upon clamping, the arm can be positioned against locking piece and/or the nut of the clamping device without using additional tools. In particular, it is also possible to provide several arms, so that reliable retention is still ensured even if one arm fails.

For attachment of the lever to the actuating ring, the lever may cooperate with an actuating ring pin that is adapted to allow the lever to be mounted to the actuating ring by a radial movement. Preferably, the lever has a passage opening or through-hole through which is passed the respective pin of the actuating ring. This allows for rapid and reliable assembly. In order to define a nominal position for the actuating ring in the through-hole of the lever, the actuating ring pin may have, for example, an annular shoulder acting as a sliding or insertion stop. Preferably, after the actuating ring pin has reached its nominal position, it is secured to the lever. The hole for the actuating ring pin is preferably relative to the axis of rotation and the chord line at the mid-span cross section of the respective airfoil. This eliminates, or at least significantly reduces, an influence of manufacturing tolerances at the contact faces on the angular position of the vane airfoil. The contact face geometry may, of course, also be produced without the hole for the actuating ring pin being relative to the vertical axis and the chord line. The positioning and creation of the hole is generally independent of the configuration of the contact faces.

In a method according to the present invention for establishing a link between a stator vane and an actuator, the stator vane having a vane stem extending along its vertical axis and being connected by a lever to an actuating ring of the actuator, the lever is positioned laterally against the vane stem in a first mounting direction and form-fittingly locked to the vane stem by a locking piece in a second mounting direction different from the first mounting direction. Mounting of the lever is no longer effected from radially outside relative to the longitudinal machine axis, but from the side. Due to the different second mounting direction of the locking piece, in particular a radial mounting direction relative to the longitudinal machine axis, a locking action is produced even without clamping.

A preferred method includes the steps of radially and pivotably mounting the lever to the actuating ring, positioning a jaw-like connecting portion of the lever laterally against a contact portion of the vane stem by laterally pivoting the lever, radially sliding a locking piece onto the vane stem until it is in locked engagement with the connecting portion, and clamping the connecting portion and the locking piece in the locked position, thereby pressing the connecting portion and the locking piece against the contact portion.

Prior to mounting the respective lever to the actuating ring, to compensate for manufacturing tolerances at the points of contact between the lever and the vane stem, a through-hole for receiving the actuating ring pin may be positioned in the lever in such a way that, to form the through-hole, the lever is pre-mounted to the vane stem and removed therefrom after the through-hole has been formed. Thus, the angular position of the respective stator vane, which is defined by its axis of rotation and the chord line at the mid-span airfoil cross section, is optimally transmitted to the position of the actuating ring pin.

To achieve reliable locking, it as advantageous to prevent the connection portion and the locking piece from becoming loose during clamping.

A turbomachine according to the present invention has a plurality of inventive lever assemblies for establishing links between stator vanes of a row of variable vanes and an actuator. The lever assemblies according to the present invention allow vane actuating mechanisms to be implemented with stator vanes that have very small stem diameters and/or are spaced at very small distances from each other. For example, the vane actuating mechanisms of the forward compressor stages or of the high-pressure compressor have such lever assemblies, so that the turbomachine can be equipped with a very powerful or performance-optimized compressor.

BRIEF DESCRIPTION OF THE DRAWINGS

Preferred exemplary embodiments of the present invention will be described in greater detail below with reference to the drawings. It is understood that individual elements and components may be combined in other ways than those described. Corresponding elements are identified by the same reference characters throughout the figures and may not be described again for each figure.

In schematic form.

DETAILED DESCRIPTION

As used herein, terms such as "radial," "radially outwardly," "radially inwardly," "coaxial," and "circumferential direction" are generally taken with respect to a longitudinal machine axis X of the inventive turbomachine, which constitutes the axis of rotation of a rotor thereof. Terms such as "lateral" and "transverse" are taken with respect to a vertical axis H of a stator vane of the turbomachine, which extends in or substantially radially to longitudinal machine axis X.

Figure 1:
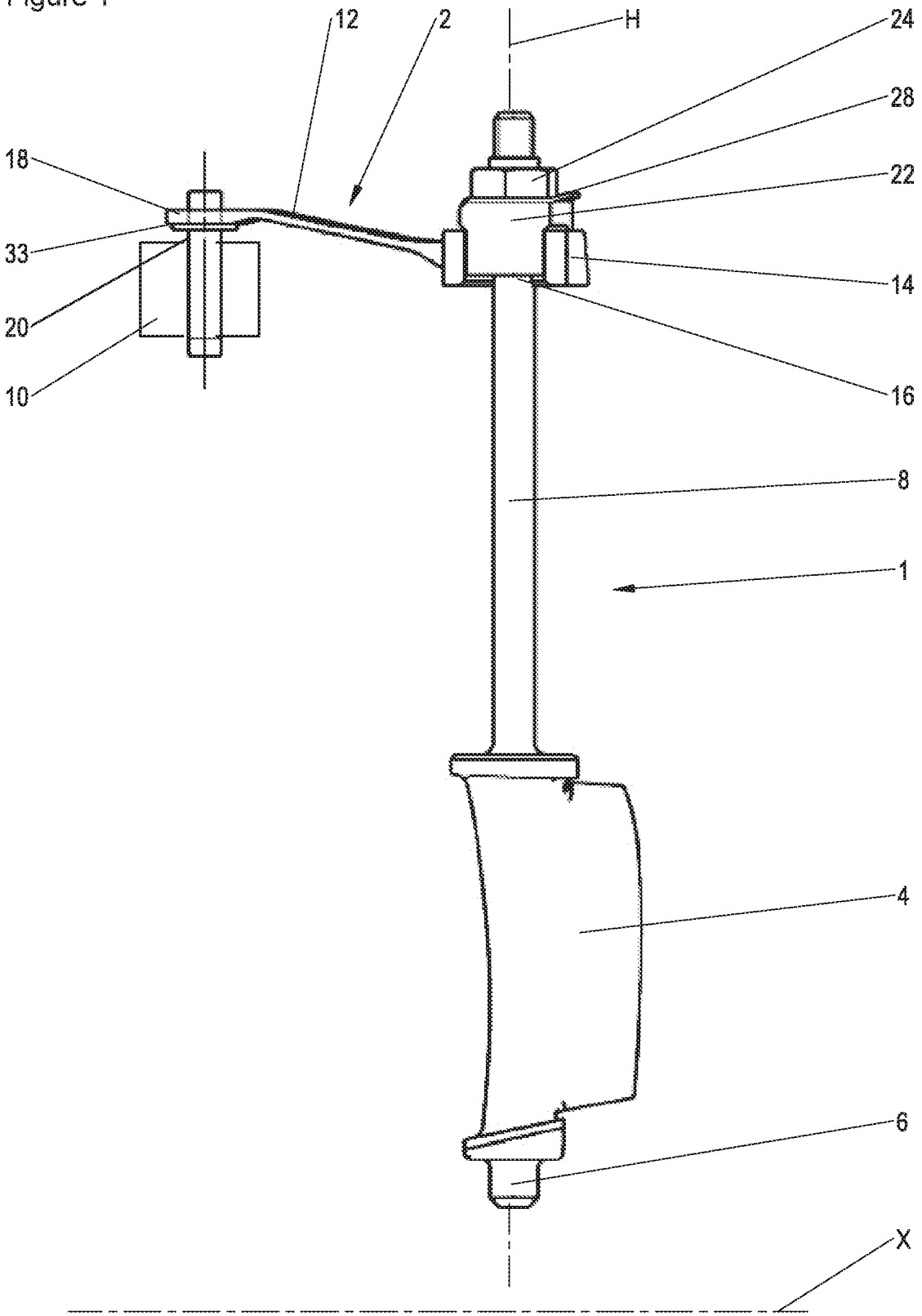
FIG. 1 shows a side view of a stator vane in the installed position and an embodiment according to the present invention of a lever assembly and an actuating ring of a vane actuating mechanism.

FIG. 1 shows a stator vane 1 of a row of variable stator vanes of a turbomachine. The turbomachine is, for example, an aircraft engine, and the row of stator vanes is disposed in the compressor of the aircraft engine.

Stator vane 1 is connected to a vane actuating mechanism via a lever assembly 2 according to the present invention. Stator vane 1 has an airfoil 4 located in a flow duct of the turbomachine, through which passes the core flow. Via a trunnion 6 radially inward of airfoil 4, stator vane 1 is supported in an inner ring. To allow engagement of lever assembly 2, the stator vane has a vane stem 8 which extends radially outwardly from airfoil 4 and out of a core flow path of the turbomachine along vertical axis H. Via lever assembly 2, which is located outside of the core flow path of the turbomachine, vane stem 8, and thus stator vane 1, is operatively connected to an actuating ring 10 disposed coaxially with the row of stator vanes and outside of the core flow path of the turbomachine. In order to adjust stator vanes 1 about their vertical axes H, actuating ring 10 is moved by an actuator, and the movement is transmitted to the rotational position of stator vanes 1. Each stator vane 1 of the row of variable stator vanes is provided with such a lever assembly 2, each of the lever assemblies being connected to actuating ring 10.

Lever assembly 2 has an actuating lever or lever 12 having a connecting portion 14 for connection to a contact portion 16 of vane stem 8 and an attachment portion 18 for attachment to a pin 20 of actuating ring 10. In addition, lever assembly 2 has a locking piece 22 for locking connecting portion 14 to contact portion 16, a clamping device 24 for clamping locking piece 22 and connecting portion 14 together with contact portion 16, and a securing element 28 for securing the clamping action. Clamping device 24 is here, for example, a nut cooperating with an external thread. Securing element 28 is here, for example, a washer.

Figure 2:
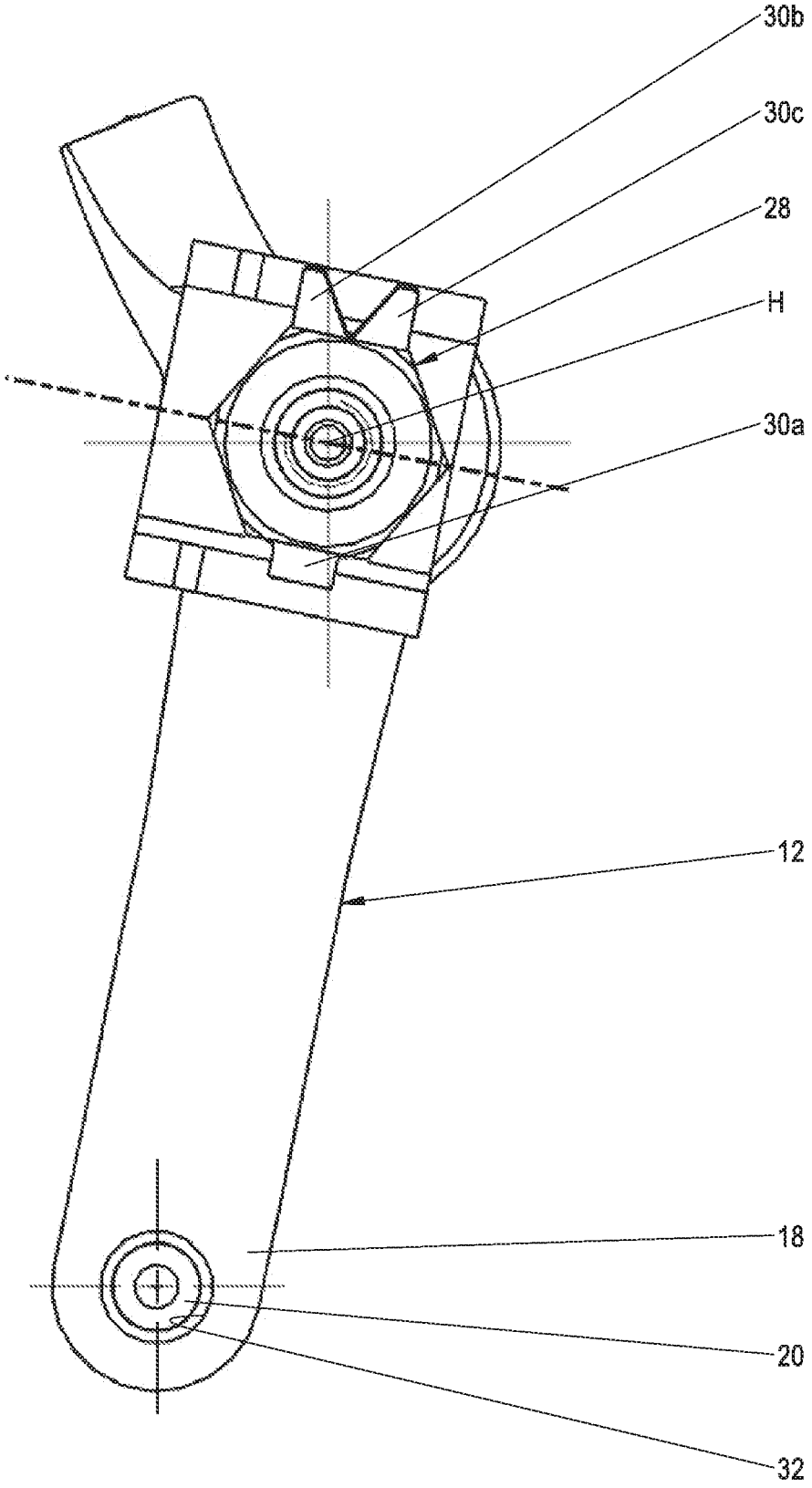
FIG. 2 shows the arrangement of FIG. 1 in top view.

As can be seen from FIG. 2, securing element 28 has here three plastically deformable and thus bendable arms 30*a*, 30*b*, 30*c*, of which one arm 30*a* extends in a direction opposite to the other two arms 30*b*, 30*c*. In the secured position, at least one of the arms 30*a* laterally engages locking piece 22, thereby preventing rotation of securing element 28 about vertical axis H.

The end of lever 2 opposite connecting portion 14 is constituted by attachment portion 18, which as a through-hole 32 allowing actuating ring pin 20 to be passed therethrough or allowing lever 12 to be radially slipped onto actuating ring pin 20, as the case may be. The positioning of through-hole 32 for actuating ring pin 20 is preferably performed relative to vertical axis H and the chord line at the mid-span cross section of airfoil 4. In order to define a nominal position on lever 12, actuating ring pin 20 has an annular shoulder 33 which engages attachment portion 18 of lever 12 in the assembled state. The formation of through-hole 32 may be effected by pre-mounting lever 12 to vane stem 8 and removing it after through-hole 32 has been formed. Thus, vane stem 8 and lever 1 are produced as a so-called "mated pair." By this measure, the angular position of the respective stator vane 1 is transmitted to actuating ring pin 20, thereby compensating for manufacturing tolerances.

Figure 3:
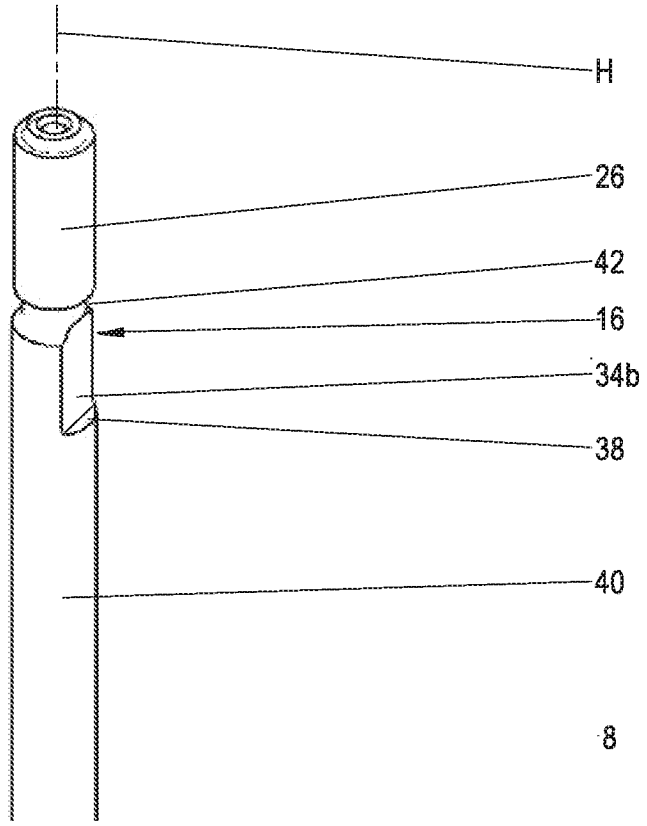
FIG. 3 illustrates a contact portion of a vane stem of the stator vane for form-fittingly receiving the lever.
Figure 4:
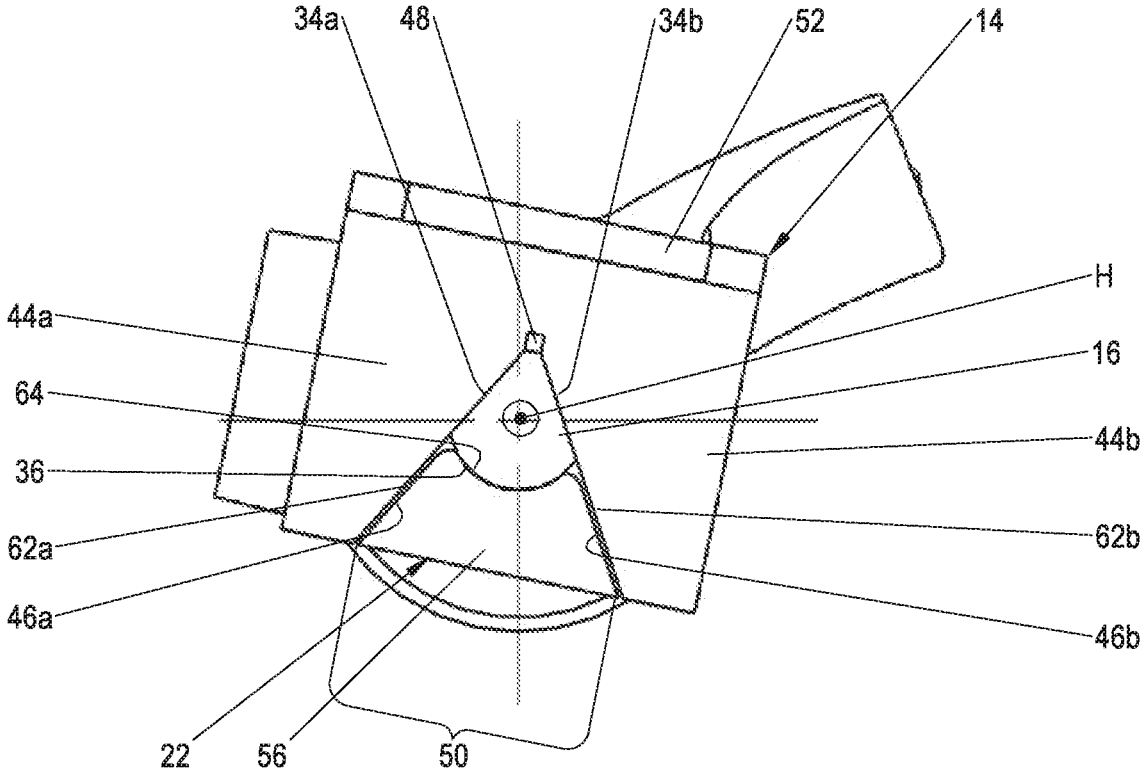
FIG. 4 illustrates a first sectional view through the contact portion of the vane stem, with the lever and the locking piece shown in the locked position.

In accordance with FIGS. 3 and 4, contact portion 16 has two contact faces 34*a*, 34*b* facing away from each other and adapted for engagement with connecting portion 14 of the lever. Contact faces 34*a*, 34*b* are plane surfaces and flattened portions of the periphery of vane stem 8. In particular, they are local cross-sectional tapers of the vane stem.

As can be seen in the radial top view of contact portion 16 in FIG. 4, contact faces 34*a*, 34*b* are angled in a roof-like manner relative to one another and, together with a circumferential face 36 disposed therebetween, form a kind of triangle. Due to its original contour, the circumferential face 36 disposed therebetween is a concave curved surface. Hence, in this exemplary embodiment, contact portion 16 has three contact faces 34*a*, 34*b*, 36, two of which are configured as plane surfaces 34*a*, 34*b* and one of which is configured as a curved surface 36. As a result, and in contrast to the adjacent stem portions 26, 40, contact portion 16 is not rotationally symmetric with respect to vertical axis H, which basically allows lever 12 to be non-rotatably secured by form fit.

In the transition region between contact faces 34*a*, 34*b* and the radially inwardly adjacent original stem portion 40, there are formed shoulder faces 38, of which only one is visible in FIG. 3 because of the perspective nature of the view. Shoulder faces 38 form supports for connecting portion 14 in the clamped state and delimit a radial position of lever 12 on vane stem 8. Shoulder faces 38 are what makes clamping possible in the first place.

Free end portion 26 of vane stem 8 is provided with the external thread for receiving nut 24 of the clamping device, the external thread being spaced from contact portion 16 by an annular groove 42.

Figure 5:
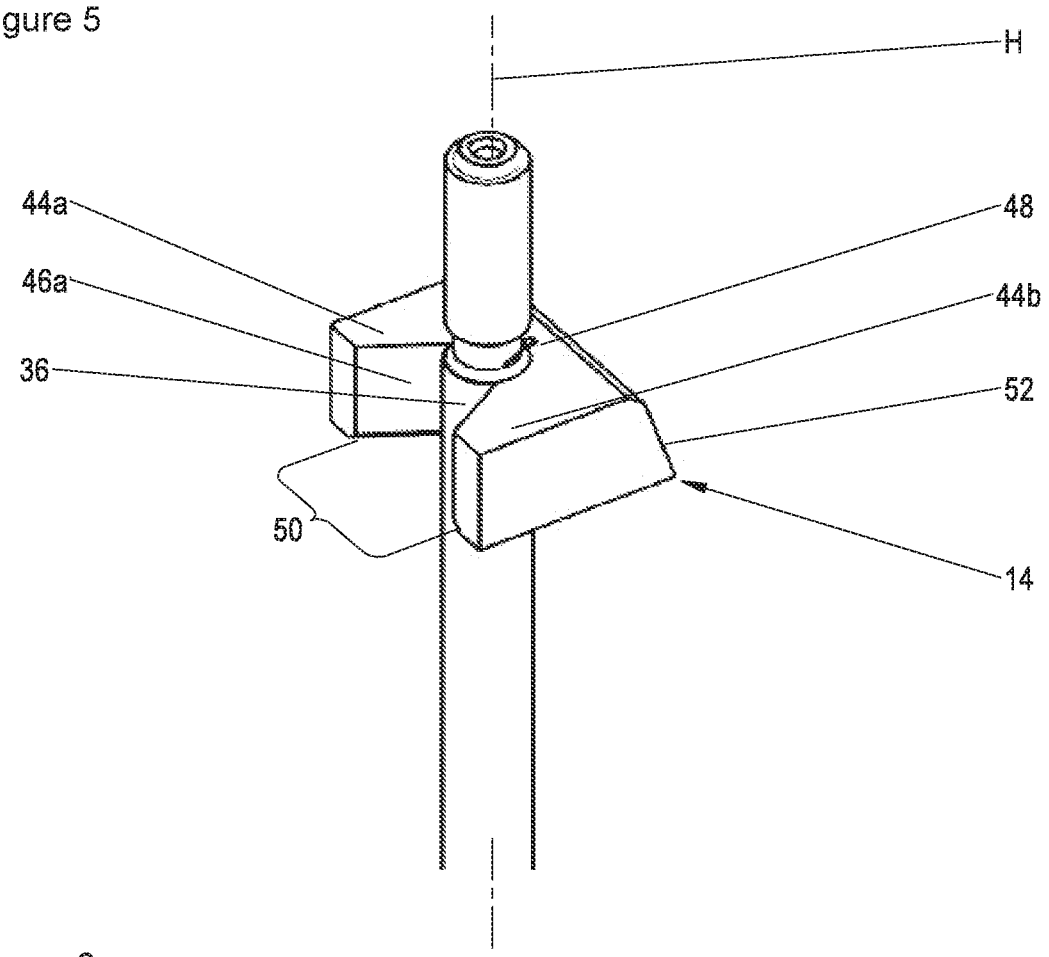
FIG. 5 shows a view similar to FIG. 3, but additionally showing a connecting portion of the lever.

As shown in FIGS. 4 and 5, connecting portion 14 is jaw-like and is, as it were, open laterally, which allows lever 12 to be positioned laterally against vane stem 8. Connecting portion 14 has two prongs 44*a*, 44*b* forming a jaw therebetween (not designated with a reference character). The jaw is bounded by two opposing jaw faces 46*a*, 46*b*, which diverge as they extend away from a jaw bottom 48 toward a jaw opening 50. Thus, the jaw has a wedge-shaped configuration, with jaw bottom 48 being significantly narrower than jaw opening 50, which allows connecting portion 14 to center itself on contact portion 16 as it is positioned laterally thereagainst. In the assembled state, each of the jaw faces 46*a*, 46*b* of connecting portion 14 engages a respective one of contact faces 34*a*, 34*b*.

Opposite jaw opening 50, the connecting portion has a mating surface or wedge surface 52 which diverges from vertical axis H as viewed from radially outward looking radially inward relative to longitudinal machine axis X.

Figure 6:
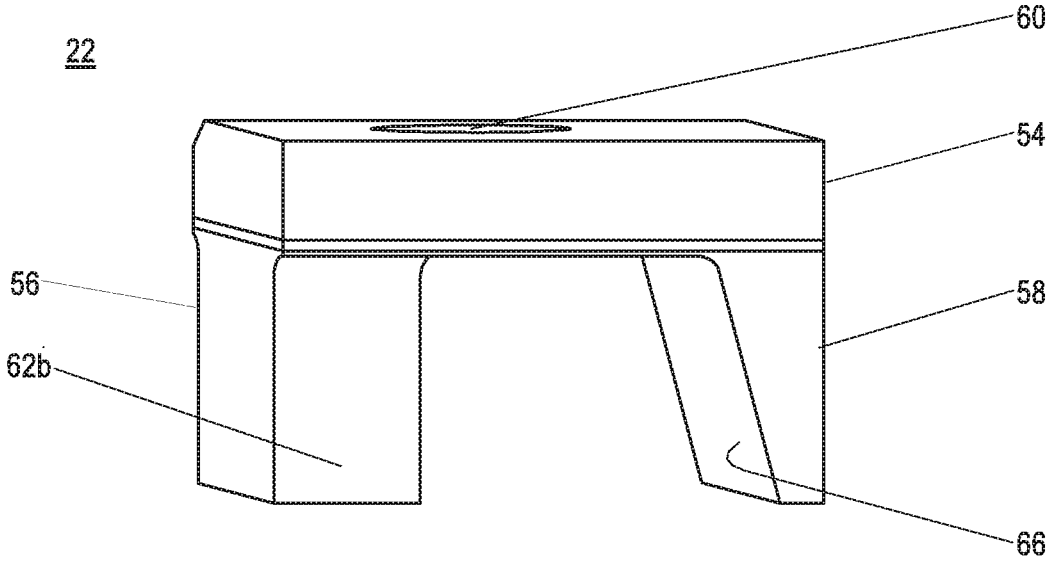
FIG. 6 shows the locking piece of the lever assembly in isolated view.

In accordance with FIGS. 5 and 6, locking piece 22 is U-shaped and has a main body 54 and two legs 56, 58 extending in the same direction from opposite narrow sides of main body 54. Main body 54 is plate-like and has a passage opening 60 allowing free end portion 26 of vane stem 8 to be passed therethrough or allowing interlocking piece 22 to be radially slipped onto vane stem 8, as the case may be. Passage opening 60 is configured to allow locking piece 22 to move laterally relative to vane stem 8 during locking and clamping.

One leg 56 is a guide leg for insertion into jaw opening 50 in the locked position. For this purpose, guide leg 56 has a shape corresponding substantially to the jaw, including two side faces 62*a*, 62*b* which face away from each other and which, in the installed position, are located opposite the jaw faces 46*a*, 46*b*. Guide leg 56 further has a convex engagement surface 64 corresponding to circumferential face 36 of vane stem 8. What is important is that guide leg 56 not come into engagement with jaw faces 46*a*, 46*b* at both of its side faces 62*a*, 62*b*, but that there always be a gap between at least one of the side faces 62*a*, 62*b* and one of jaw faces 46*a*, 46*b*, because otherwise its engagement surface 64 could not be brought into engagement with circumferential face 36 of the stem, and thus clamping would be impossible because guide leg 56 would be jammed in jaw opening 50. As can be seen in FIG. 4, in the locked and clamped state, preferably none of the side faces 62*a*, 62*b* is in engagement with jaw faces 46*a*, 46*b*, but instead they are spaced from the respective jaw faces 46*a*, 46*b*. However, engagement surface 64 is in engagement with circumferential face 36 of the stem.

Wedged leg 58 has a wedged leg surface 66 facing toward guide leg 56. Wedged leg surface 66 has an inclination corresponding to that of wedge surface 52 of connecting portion 14, so that near main body 54, wedged leg surface 66 is closer to guide leg 56 than further away from main body 54. This orientation of wedge surface 52 and wedged leg surface 66 causes connecting portion 14 and locking piece 22 to be pressed against contact faces 34*a*, 34*b* and circumferential face 36 of contact portion 16, respectively, during locking and clamping.

Figure 11:
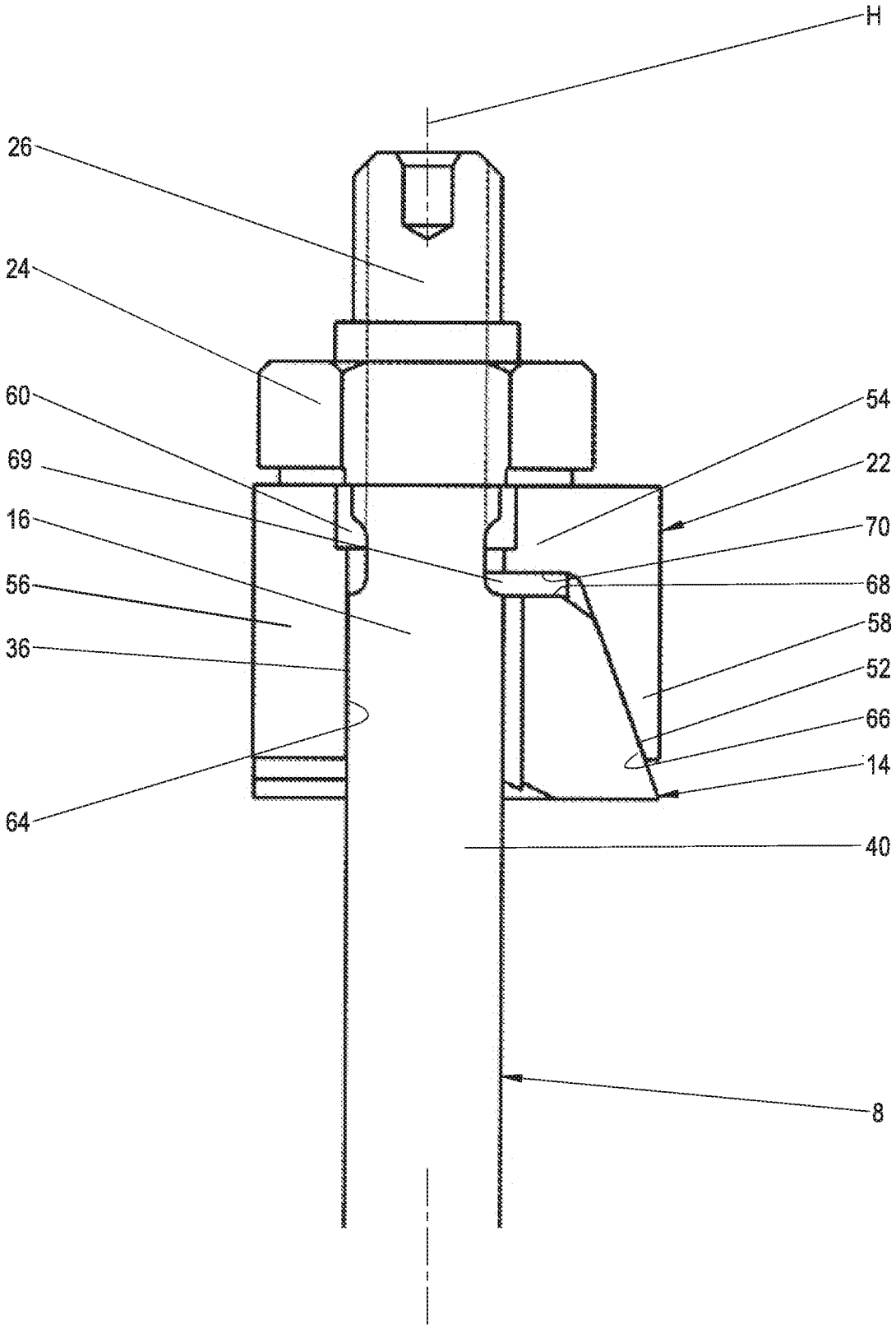
FIG. 11 shows a second sectional view through the contact portion of the vane stem, with the lever and the locking piece shown in the locked position.

In order to prevent locking piece 22 from moving with its main body 54 against an upper side 68 of connection portion 14 facing main body 54 during locking and clamping, guide leg 56 and wedged leg 58 are spaced apart such that in the installed position, there is always a radial gap 69 between a lower side 70 of main body 54 and upper side 68 of the connecting portion (FIG. 11).

In a method according to the present invention for mounting the inventive lever assembly 2 to a vane stem 8 of a stator vane 1 of a row of stator vanes, it is an essential feature that lever 12 of lever assembly 2 is positioned laterally against contact portion 16 of vane stem 8 of stator vane 1 in a first mounting direction and form-fittingly locked to vane stem 8 by locking piece 22 in a second mounting direction. Prior to positioning lever 12 laterally against contact portion 16 of the vane stem, lever 12 is mounted to actuating ring 10 in a mounting direction equal to the second mounting direction. Thus, after attachment to actuating ring pin 20, lever 12 is pivoted laterally until its connecting portion 14 is in engagement with contact portion 16 of vane stem 8. This assembly procedure is repeated until each stator vane 1 of the row of stator vanes is provided with the lever assembly 2 according to the present invention.

In the following, the method according to the present invention will be described in detail. As mentioned hereinbefore, terms such as "radial" are taken with respect to longitudinal machine axis X of the inventive turbomachine, which constitutes the axis of rotation of a rotor thereof. Terms such as "lateral" are taken with respect to vertical axis H of stator vane of 1 the turbomachine, which extends in or substantially radially to longitudinal machine axis X.

Figure 7:
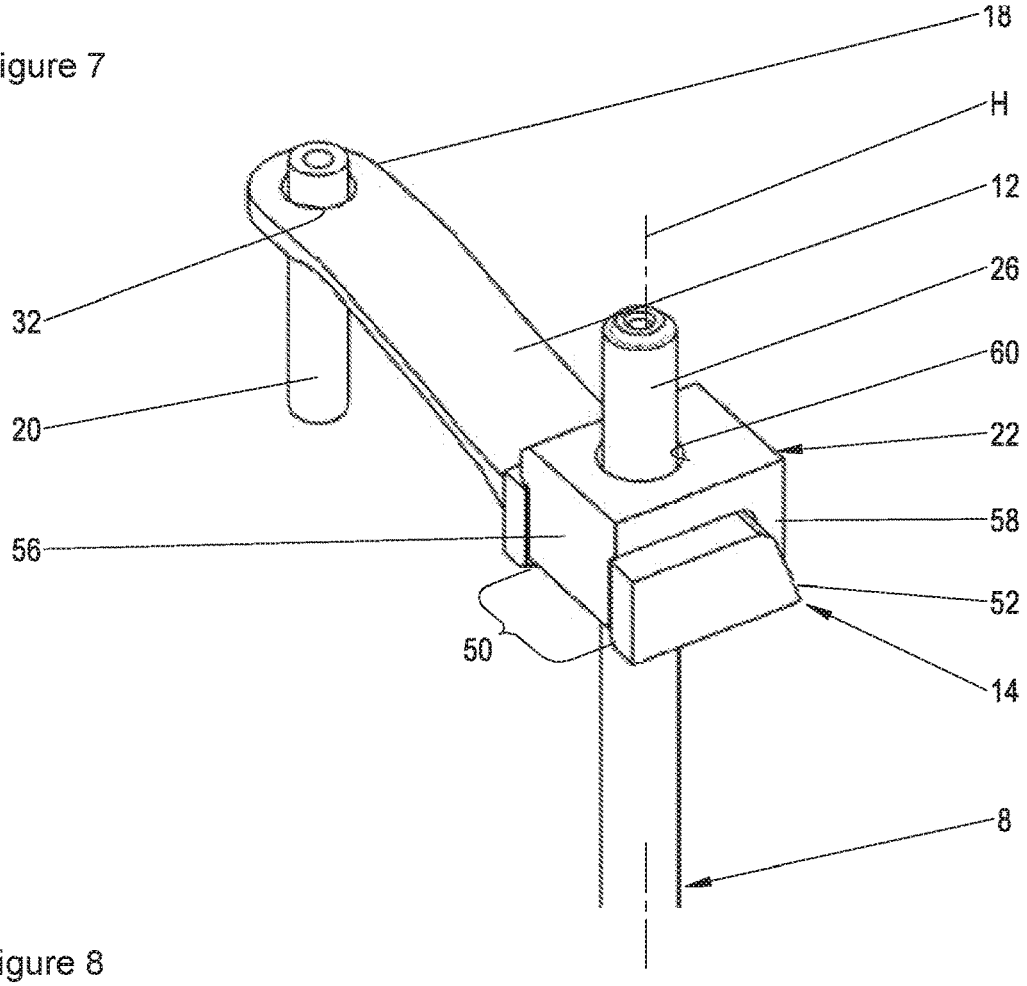
FIGS. 7-10 illustrate steps for mounting the lever assembly.
Figure 8:
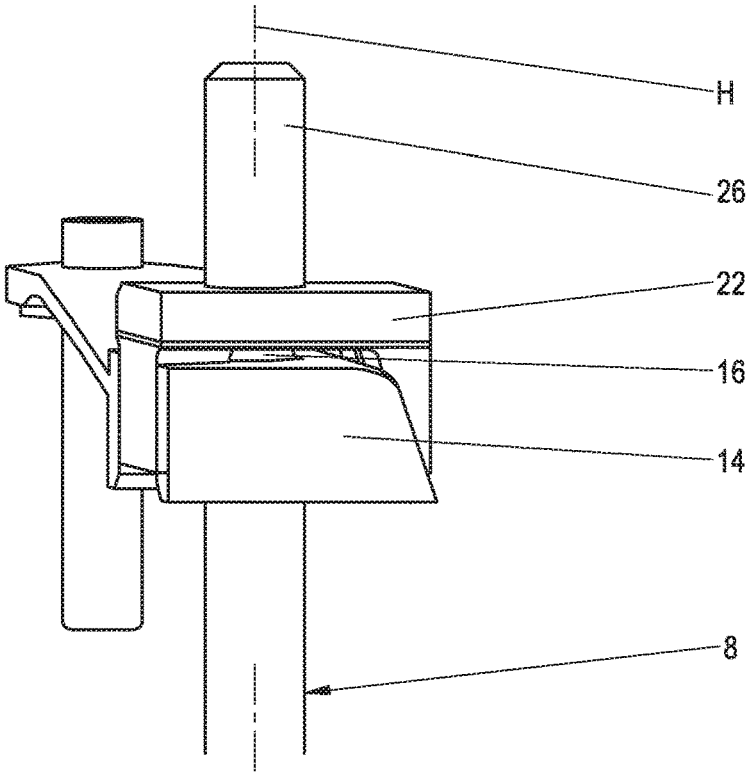

Initially, during assembly, the respective actuating ring pin 20 is secured to lever 12 (compare FIGS. 1 and 7). To this end, actuating ring pin 20 is passed through through-hole 32 of attachment portion 18 up to annular shoulder 33 and then connected thereto. Thereafter, lever 12 is mounted to actuating ring 10 by the pre-mounted actuating ring pin 20. To this end, the respective actuating ring pin 20 on lever 12 is radially inserted into a receptacle of actuating ring 10. Subsequently, lever 12 is pivoted about actuating ring pin 20 until its connecting portion 14 comes against contact portion 16, so that jaw faces 46*a*, 46*b* are in engagement with contact faces 34*a*, 34*b* (see FIG. 4). Connecting portion 14 rests radially on shoulder faces 38 of vane stem 8 (see FIG. 3). Then, locking piece 22 is slid via its passage opening 60 radially over free end portion 26 onto vane stem 8 in such a way that its guide leg 56 enters jaw opening 50 and virtually closes the same (FIG. 7). At the same time, locking piece 22 comes to rest with its wedged leg 58 against wedge surface 52. Due to wedge surface 52 and wedged leg surface 66 of wedged leg 58, lever 12 centers itself on vane stem 8. This is because, in accordance with the illustration of FIG. 8, wedge surface 52 and wedged leg surface 66 cause connecting portion 14 to move to the left and locking piece 22 to slidingly move to the right along wedge surface 52. Connecting portion 14 and locking piece 22 are moved toward each other, thereby clamping the contact portion 16 of vane stem 8 located therebetween.

Figure 9:
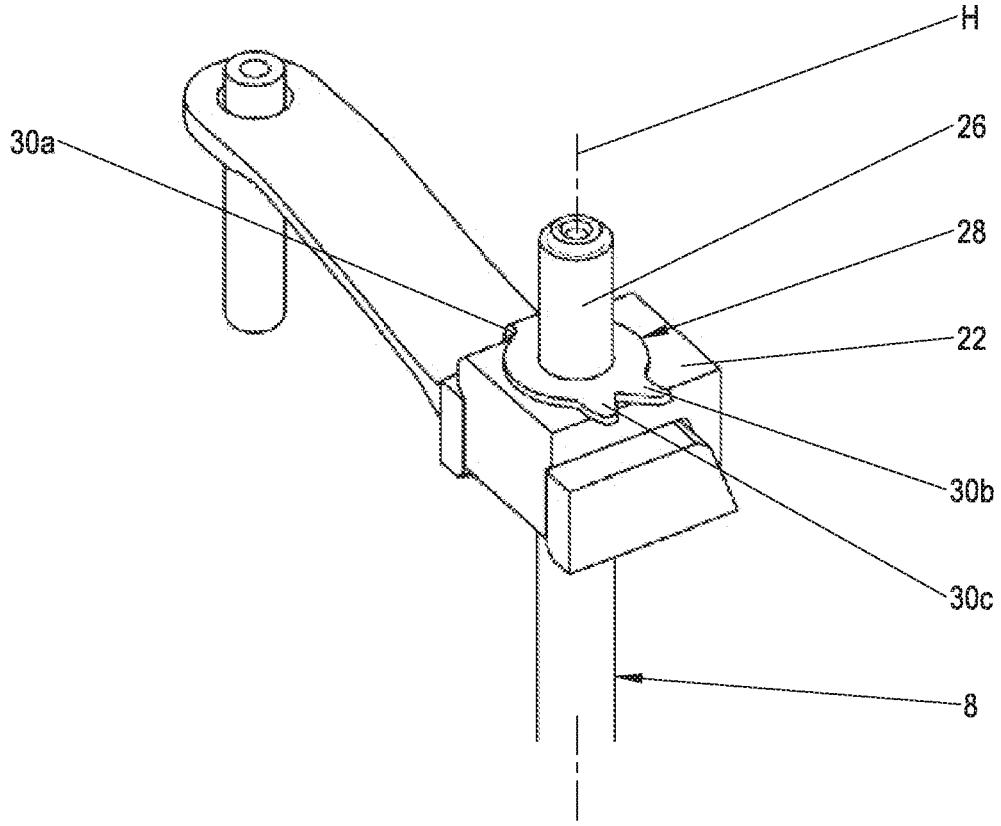

As illustrated in FIG. 9, after locking is complete, securing element 28 is slid radially over free end portion 26 onto vane stem 8 until it rests on locking piece 22. Then, at least one arm 30*a* of securing element 28 is bent such that it laterally engages locking piece 22 and is thereby prevented from rotation.

Figure 10:
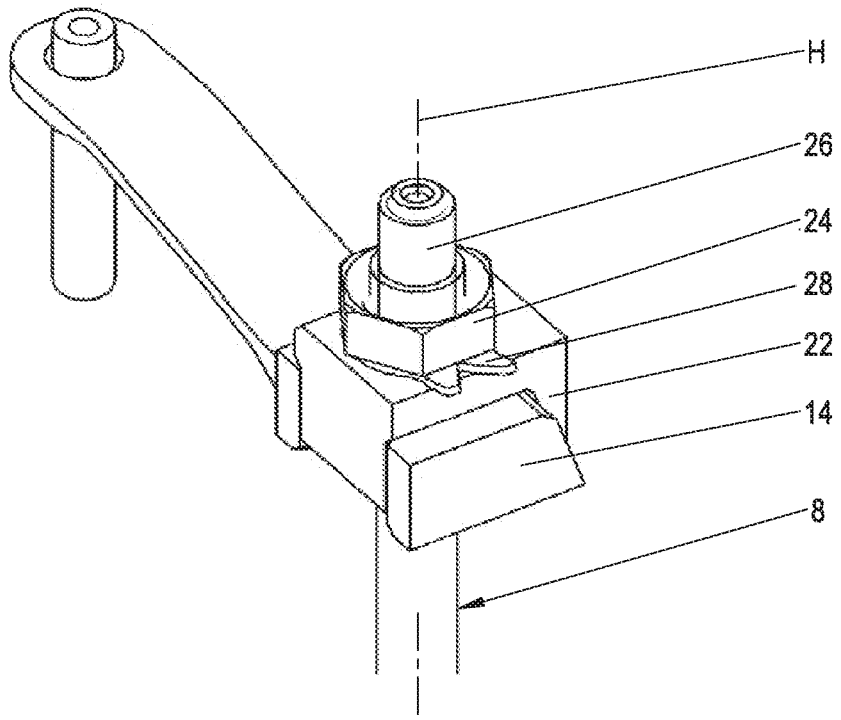

Subsequently, as shown in FIG. 10, nut 24 of the clamping device is screwed onto the external thread of free end portion 26. Since connecting portion 14 rests radially on shoulder faces 38 of vane stem 8, it cannot escape radially inwardly. As a result, connecting portion 14 and locking piece 22 are pressed with a defined clamping force against contact portion 16, so that in the locked position, connecting portion 14 and locking piece 22 are form-fittingly connected to contact portion 16. The clamping is such that play-free locking is achieved. Nut 24 is restrained from loosening rotation by self-retention and here, for example, additionally by bending at least one of arms 30*b*, 30*c* against the tightened nut (not illustrated).

In FIG. 11, the locking of lever 12 on vane stem 8 in the region of contact portion 16 is shown in a cross sectional view, illustrating, in particular, the interaction of wedged leg surface 66 with wedge surface 52, the engagement of engagement surface 64 on circumferential face 36 of vane stem 8, and the radial spacing of lower side 70 of main body 54 of locking piece 22 from upper side 68 of connection portion 14 in the locked and clamped state. It is also clearly discernible that passage opening 60 in main body 54 of locking piece 22 has such an inner diameter that free end portion 26 is received with play in passage opening 60, which allows locking piece 22 to move laterally relative to the vane stem 8 during locking and clamping.

It is noted that the present invention also encompasses exemplary embodiments where actuating ring pins 20 are not pre-mounted to levers 12. For example, actuating ring pins 20 may be previously mounted to actuating ring 10, and levers 12 may then each be slipped onto a respective one of the actuating ring pins 20 mounted to actuating ring 10.

Disclosed is a lever assembly forming part of a vane actuating mechanism and serving to connect a stator vane of a turbomachine to an actuating ring of an actuator, which lever assembly is adapted such that an actuating lever of the lever assembly is moved in a first mounting direction transversely to a vane stem of the stator vane extending radially relative to a longitudinal machine axis of the turbomachine and is thereby positioned laterally against the vane stem, and that the actuating lever is radially form-fittingly locked to the vane stem by a locking piece in a second mounting direction. Also disclosed are an assembly method and a turbomachine.

LIST OF REFERENCE CHARACTERS

1 stator vane
2 lever assembly
4 airfoil
6 trunnion
8 vane stem
10 actuating ring
12 actuating lever/lever
14 connecting portion
16 contact portion
18 attachment portion
20 actuating ring pin
22 locking piece
24 clamping device/nut
26 free end portion
28 securing element
30*a, b, c* arms
32 through-hole
33 annular shoulder
34*a, b* contact faces
36 circumferential face/contact face
38 shoulder face
40 adjacent stem portion
42 annular groove
44*a, b* prongs
46*a, b* jaw faces
48 jaw bottom
50 jaw opening
52 wedge surface/mating surface
54 main body
56 leg/guide leg
58 leg/wedged leg
60 passage opening
62*a, b* side face
64 engagement surface
66 wedged leg surface
68 upper side of the connecting portion
69 radial gap
70 lower side of the main body
H vertical axis
X longitudinal machine axis

What is claimed is:

1. A lever assembly forming part of a vane actuating mechanism of a turbomachine and serving to establish a link between a stator vane and an actuator, the lever assembly comprising:

a lever and a U-shaped locking piece;

the stator vane having a vane stem extending along a vertical axis and being connectable by the lever to an actuating ring of the actuator, the lever having has a jaw connecting portion, the lever being engageable via the jaw connecting portion with a contact portion of the vane stem; and the U-shaped locking piece provided for locking the jaw connecting portion to the vane stem, the U-shaped locking piece having a passage opening formed in a main body allowing the U-shaped locking piece to be slid onto the vane stem and further having two legs extending from the main body at opposite ends, a first leg of the two legs being adapted for insertion into a jaw opening of the jaw connecting portion and a second leg being adapted for engagement with a mating surface of the jaw connecting portion, the mating surface being opposite the jaw opening; the jaw connecting portion and the locking piece being form-fittingly connected to the contact portion when in a locked position.

2. The lever assembly as recited in claim 1 wherein the connecting portion has opposing jaw faces and the contact portion has contact faces configured to match the jaw faces, respectively, and the jaw faces and the contact faces being angled relative to each other, respectively.

3. The lever assembly as recited in claim 2 wherein the contact faces are created by cross-sectional tapers of the vane stem, and the contact faces each merge via a respective shoulder face into a stem portion adjacent to the contact portion, the shoulder faces forming supports for the connecting portion.

4. The lever assembly as recited in claim 2 wherein the mating surface of the connection portion is a wedge surface and the second leg has a wedged leg surface, the wedge surface and the wedged leg surface being adapted such that the connecting portion and the locking piece are moved toward the contact faces of the contact portion during mounting of the locking piece.

5. The lever assembly as recited in claim 1 wherein the first leg has an engagement surface for engagement with a contact face of the contact portion.

6. The lever assembly as recited in claim 2 wherein the jaw faces of the connecting portion diverge as the jaw faces extend away from a jaw bottom toward the jaw opening, and the first leg has side faces corresponding to the jaw faces, and wherein at least one of the side faces is spaced apart from one of the jaw faces opposite thereto in an assembled state.

7. The lever assembly as recited in claim 1 further comprising a clamping device for clamping the connecting portion and the locking piece in the locked position.

8. The lever assembly as recited in claim 7 further a securing element positionable between the U-shaped locking piece and the clamping device and having at least one arm bendable to laterally engage the U-shaped locking piece or the connecting portion.

9. The lever assembly as recited in claim 1 wherein the lever cooperates with an actuating ring pin for attachment to the actuating ring, actuating ring pin being adapted to allow attachment to the actuating ring to be accomplished by a radial movement of the lever.

10. A method for establishing a link between a stator vane and an actuator, the method comprising:

connecting the stator vane, the stator vane having a vane stem extending along a vertical axis, via a lever to an actuating ring of the actuator; the connecting including positioning the lever laterally against the vane stem in a first mounting direction and form-fittingly locking the lever to the vane stem by a locking piece in a second mounting direction different from the first mounting direction.

11. The method as recited in claim 10 wherein the connecting step includes radially and pivotably mounting the lever to the actuating ring;

positioning a jaw-like connecting portion of the lever laterally against a contact portion of the vane stem by laterally pivoting the lever;

radially sliding the locking piece onto the vane stem until in locked engagement with the connecting portion; and clamping the connecting portion and the locking piece while in the locked engagement, thereby pressing the connecting portion and the locking piece against the contact portion.

12. The method as recited in claim 10 wherein prior to mounting the lever to the actuating ring, a through-hole for receiving an actuating ring pin is formed in the lever, and wherein, to form the through-hole, the lever is pre-mounted to the vane stem and removed therefrom after the through-hole has been formed.

13. The method as recited in claim 10 wherein the connection portion and the locking piece are prevented from becoming loose during clamping.

14. A turbomachine comprising a plurality of lever assemblies, each lever assembly as recited in claim 1, for establishing links between stator vanes of a row of variable vanes and the actuator.

* * * * *